US006926540B1

(12) United States Patent
Juntwait

(10) Patent No.: US 6,926,540 B1
(45) Date of Patent: Aug. 9, 2005

(54) TRANSMISSION MODULE ASSEMBLY HAVING PRINTED CIRCUIT BOARD

(75) Inventor: Eric D. Juntwait, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/778,702

(22) Filed: Feb. 12, 2004

(51) Int. Cl.[7] ..... H01R 13/52

(52) U.S. Cl. ..... 439/76.1; 439/276; 439/936; 439/95; 439/607

(58) Field of Search ..... 439/76.1, 607, 439/92, 95, 620, 276, 936, 722; 174/52.2

(56) References Cited

U.S. PATENT DOCUMENTS 3,951,490 A * 4/1976 Devendorf ..... 439/76.1
4,811,165 A * 3/1989 Currier et al. ..... 439/76.1
4,993,956 A 2/1991 Pickles et al.
5,040,994 A * 8/1991 Nakamoto et al. ..... 439/76.1
5,154,618 A 10/1992 Nikoloff et al.
5,263,880 A * 11/1993 Schwarz et al. ..... 174/52.2
5,905,637 A 5/1999 Su

* cited by examiner

*Primary Examiner*—Tho D. Ta
*Assistant Examiner*—Felix O. Figueroa
(74) *Attorney, Agent, or Firm*—Wei Te Chung

(57) ABSTRACT

A module assembly includes a module cover including a bottom wall, a front wall, a rear wall and two opposite side walls defining a receiving cavity therebetween, an electrical connector and a printed circuit board both received in the receiving cavity and a cover member covering the receiving cavity. The module cover has a mating portion with a mating space defined therein. The front wall defines passageways communicating with the receiving cavity and the mating space. The connector includes an insulating housing and a number of terminals retained in the housing. Each terminal includes an engaging portion extending beyond a front face of the housing into the mating space through a corresponding passageway and a press-tail extending upwardly beyond a top face of the housing. The printed circuit board defines plated through holes compliantly receiving the press-fit tails of the terminals.

16 Claims, 8 Drawing Sheets

TRANSMISSION MODULE ASSEMBLY HAVING PRINTED CIRCUIT BOARD

BACKGROUND OF THE INVENTION

1. Field of the Invention

The present invention relates to a transmission module assembly, and particularly to a transmission module assembly having a module cover receiving an electrical connector and a printed circuit board electrically connecting with the electrical connector.

2. Description of Related Art

Transmission module assemblies are widely used in computers or vehicles for controlling various functions. Such a transmission module assembly generally comprises a printed circuit board and contact elements electrically connecting with the printed circuit board. U.S. Pat. Nos. 4,993,956, 5,154,618 and 5,905,637 each disclose such an assembly.

U.S. Pat. No. 4,993,956 discloses an electrical connector comprising a base housing defining a cavity, a printed circuit board removably received in the cavity, contact elements disposed on opposite longitudinal walls of the cavity and having contact beams electrically engaging conductive pads on the printed circuit board and a cover covering the cavity to retain and protect the printed circuit board. With the printed circuit board received in the cavity of the base housing, walls of the cover are fitted within the cavity and held in place by respective downwardly facing shoulders on noses of the contact elements engaging upwardly facing shoulders on respective front and rear walls of the cover. The printed circuit board is held in place and urged against the contact beams by respective downwardly facing shoulders on the front and the rear walls of the cover. It is obvious that employing the cover to position the printed circuit board and urge an electrical engagement between the printed circuit board and the contact elements complicates the assembling process and increases the manufacturing cost.

U.S. Pat. No. 5,154,618 (hereinafter the '618 patent) discloses an electronic device including a first assembly and a second assembly interconnecting with each other. The second assembly is comprised of a base having forward and rearward portions configured to receive the first assembly in an overlapping relation. The rearward portion includes opposite upwardly extending sidewalls, a front wall and a rear wall defining a mounting space therebetween. A printed circuit board having an electrical connector mounted thereon is received in the mounting space. The front wall defines an opening configured to receive the electrical connector. After the printed circuit board together with the connector is received in the mounting space, a cover member is secured to the base.

U.S. Pat. No. 5,905,637 (hereinafter the '637 patent) discloses a module assembly comprising a casing defining a mounting space and plural insertion slots, a printed circuit board mounted in the mounting space and holding a front connector and a rear connector, and a top cover covered on the casing and fastened to the rear connector. Terminals on the front connector are disposed in alignment with the insertion slots of the casing for engaging with corresponding terminals of an electronic device.

Both the '618 patent and the '637 patent disclose that after the connector has been installed on the printed circuit board, a soldering procedure is performed to electrically connect the terminals of the connector and the printed circuit board together, and then the printed circuit board is fastened to the mounting space. Accordingly, the assembling process is complicated and the manufacturing cost is correspondingly increased.

Subsequently, some people skilled in the art make great efforts to develop a module assembly to solve the above-mentioned problems but still ineffective. The module assembly comprises a module housing with terminals insert molded therein and a printed circuit board assembled to the module housing to electrically connect with the terminals. However, the process of insert molding the terminals with the module housing is expensive. Further, a soldering procedure is still employed to connect the terminals and the printed circuit board. Therefore, the manufacturing cost is still not decreased.

Hence, an improved module assembly is required to overcome the disadvantages of the related art.

SUMMARY OF THE INVENTION

Accordingly, a first object of the present invention is to provide a transmission module assembly having an electrical connector and a printed circuit board conveniently assembled to a module cover, thereby reducing assembling process.

A second object of the present invention is to provide a transmission module assembly having an electrical connector installed in a module cover and a printed circuit board assembled into the module cover to have a solderless electrical connection with the electrical connector.

A third object of the present invention is to provide a transmission module assembly having a module cover not only receiving a printed circuit board and an electrical connector but also providing EMI (Electro Magnetic Interference) shielding.

In order to achieve the objects set forth, a module assembly comprises a module cover including a bottom wall, a front wall, a rear wall and two opposite side walls defining a receiving cavity therebetween, an electrical connector and a printed circuit board both received in the receiving cavity and a cover member covering the receiving cavity. The module cover has a mating portion with a mating space defined therein. The front wall defines a plurality of passageways communicating with the receiving cavity and the mating space. The connector comprises an insulating housing and a plurality of terminals retained in the housing. Each terminal includes an engaging portion extending beyond a front face of the housing into the mating space through a corresponding passageway and a press-tail extending upwardly beyond a top face of the housing. The printed circuit board defines plated through holes compliantly receiving the press-fit tails of the terminals.

According to one aspect of the present invention, the module cover is made from plastic material and is metalized on the inside area to provide EMI (Electro Magnetic Interference) shielding. The cover member is made from metal material. A grounding member is attached to a metal-coated inner face of the front wall and electrically connects the metal-coated inner face of the front wall to a grounding pad on the printed circuit board.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
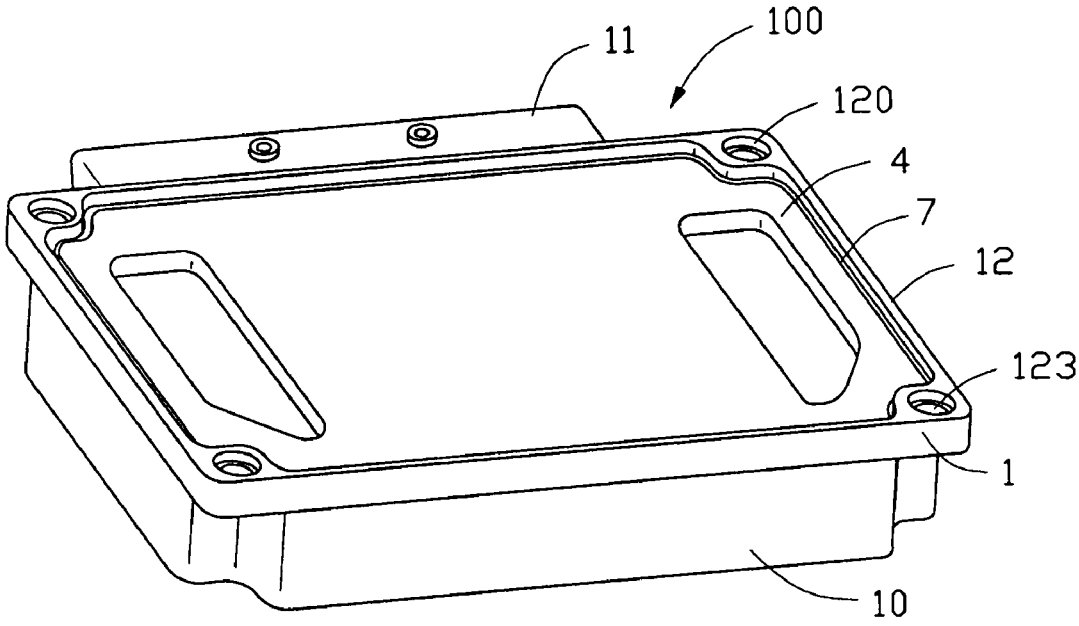
FIG. 1 is a perspective view of a transmission module assembly in accordance with the present invention.
Figure 2:
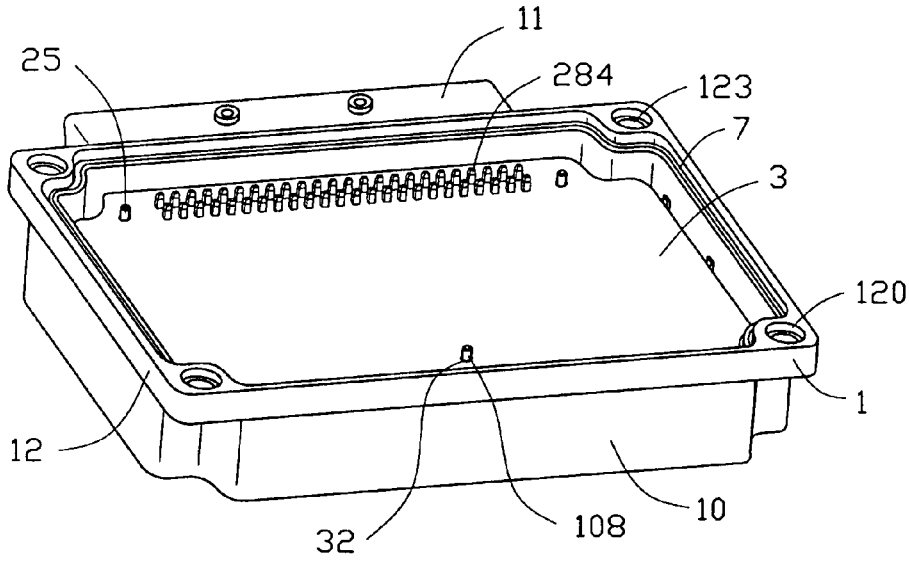
FIG. 2 is a perspective view of the transmission module assembly without installing a cover.
Figure 3:
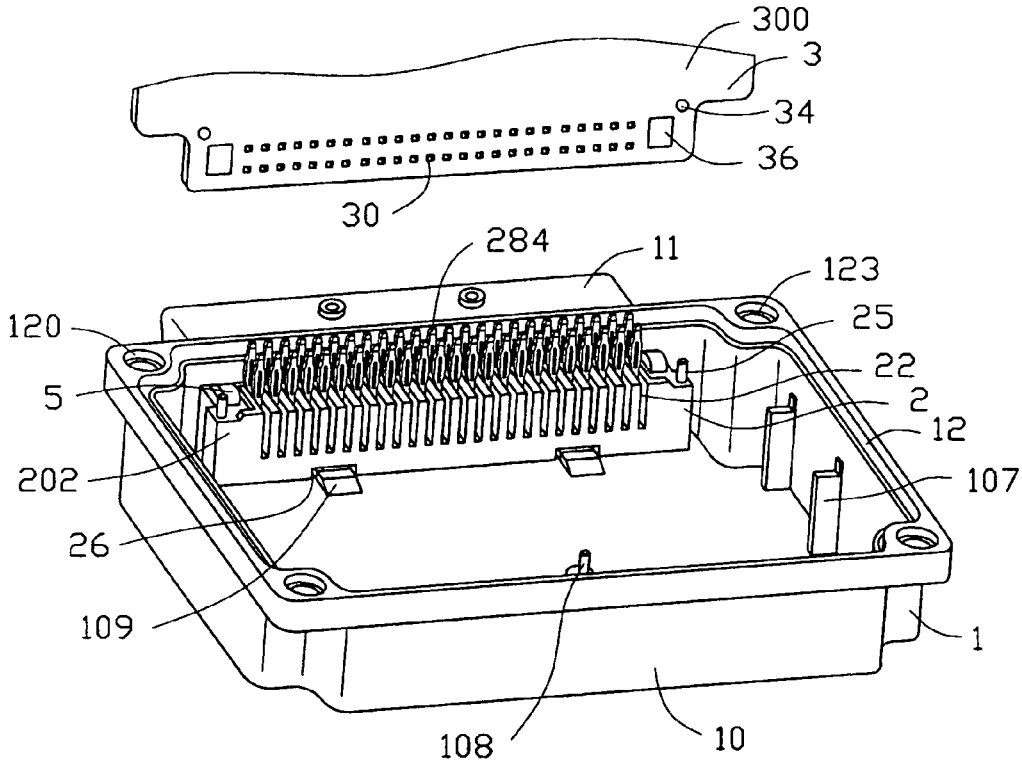
FIG. 3 is a perspective view of a module cover with an electrical connector installed therein and a printed circuit board of the transmission module assembly.
Figure 4:
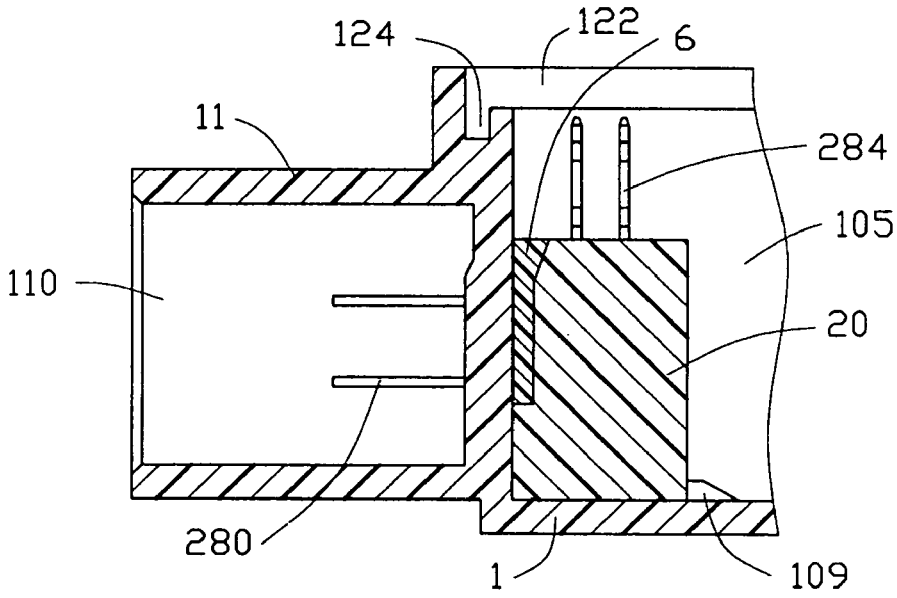
FIG. 4 is a partially cross-section view of the module cover and the electrical connector shown in FIG. 3.

Referring to FIGS. 1, 2 and 3, a transmission module assembly 100 in accordance with the present invention comprises a module cover 1, an electrical connector 2 received in the module cover 1, a printed circuit board 3 installed into the module cover 1 to have an electrical connection with the electrical connector 2, and a cover member 4 assembled to the module cover 1 to protect the printed circuit board 3.

Figure 5:
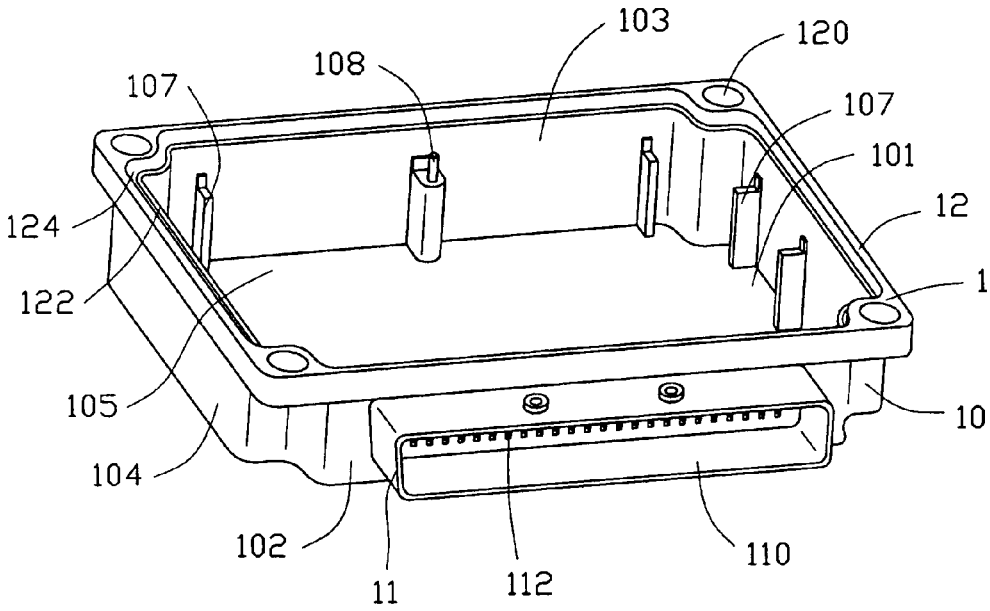
FIG. 5 is a perspective view of the module cover of the transmission module assembly.
Figure 6:
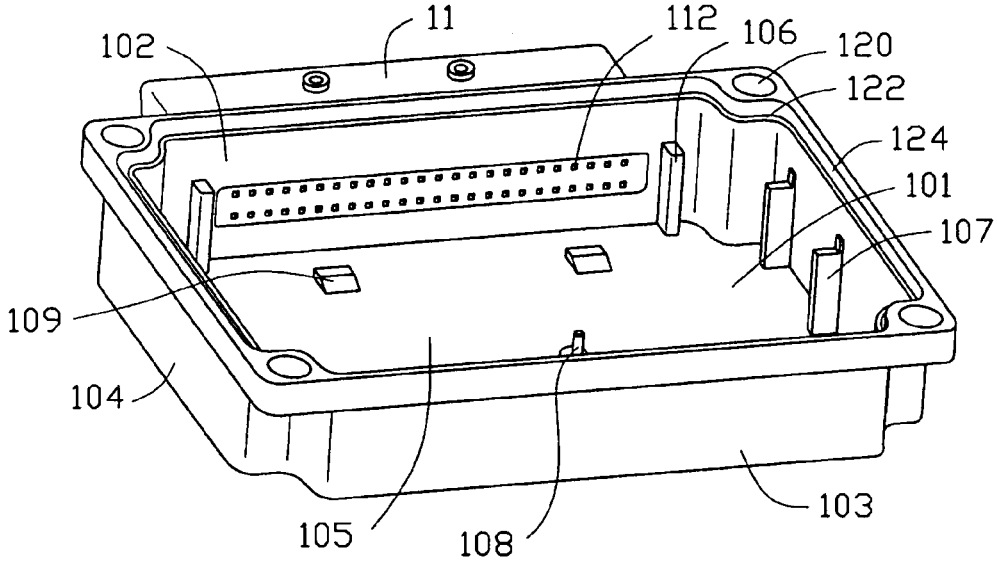
FIG. 6 is a view similar to FIG. 5 but taken from a different aspect.

Referring to FIGS. 5 and 6, the module cover 1 includes a body 10, a mating portion 11 and a flange 12. The body 10 has a bottom wall 101, a front and a rear walls 102, 103 respectively extending upwardly from front and rear edges of the bottom wall 101, and a pair of opposite side walls 104 extending upwardly from opposite side edges of the bottom wall 101, together defining a receiving cavity 105 therebetween. The mating portion 11 extends forwardly from the front wall 102 and defines a mating space 110. The front wall 102 of the body 10 defines a plurality of passageways 112 therethrough to communicate with the mating space 110 of the mating portion 11. The front wall 102 of the body 10 has a pair of guiding posts 106 formed on an inner face thereof for guiding the insertion of the electrical connector 2. A plurality of supporting bumps 107 is formed on an inner face of the rear wall 103 and the opposite side walls 104 of the body 10. A first polarizing post 108 extends upwardly from a corresponding supporting bump 107. The bottom wall 101 is formed with a pair of snap protrusions 109 in the receiving cavity 105 adjacent the front wall 102.

The flange 12 is formed on a top of the body 10. The flange 12 defines four mounting holes 120 at four corners thereof each receiving a steel bushing 123, a recess 122 in a top thereof around the receiving space 105, and a slot 124 recessed downwardly from the recess 122. Four bolts (not shown) are used going through the four steel bushings 123 for mounting the module assembly 100 to the transmission of a vehicle somewhere in an engine compartment.

The module cover 1 is made from plastic material and is metalized on the inside area to provide EMI (Electro Magnetic Interference) shielding. A predetermined area of the inner face of the front wall 102 is masked from the metalization in order to keep electrical separation between each electrical circuit. In an alternative embodiment, a stamped and formed metal shield can also be used instead of metalizing the plastic.

Figure 7:
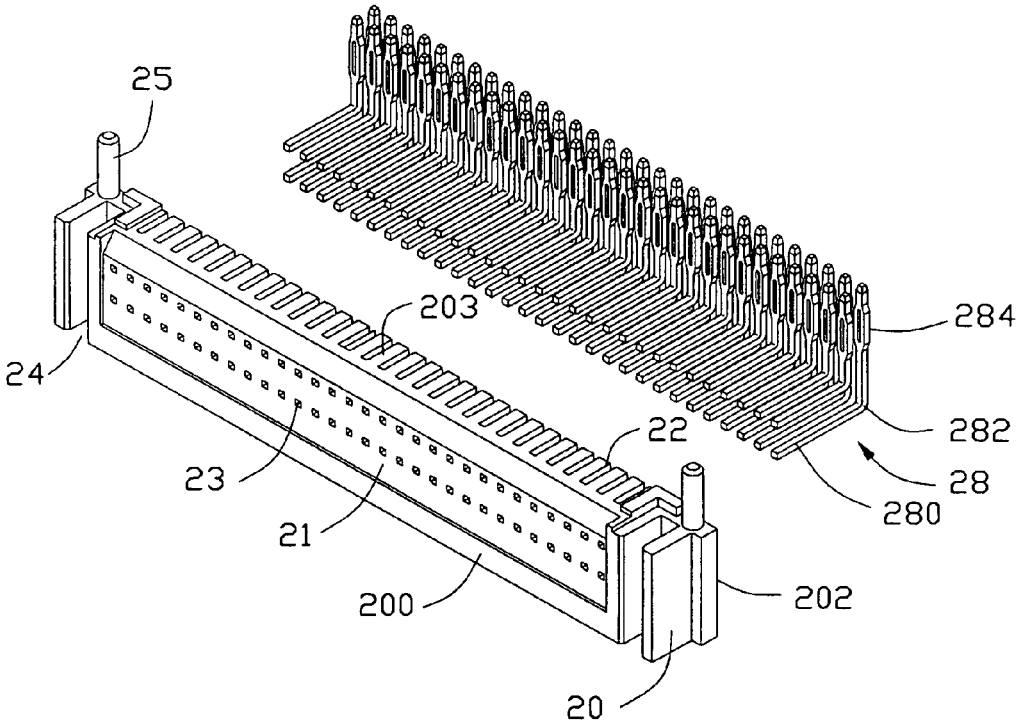
FIG. 7 is an exploded perspective view of the electrical connector shown in FIG. 3.
Figure 8:
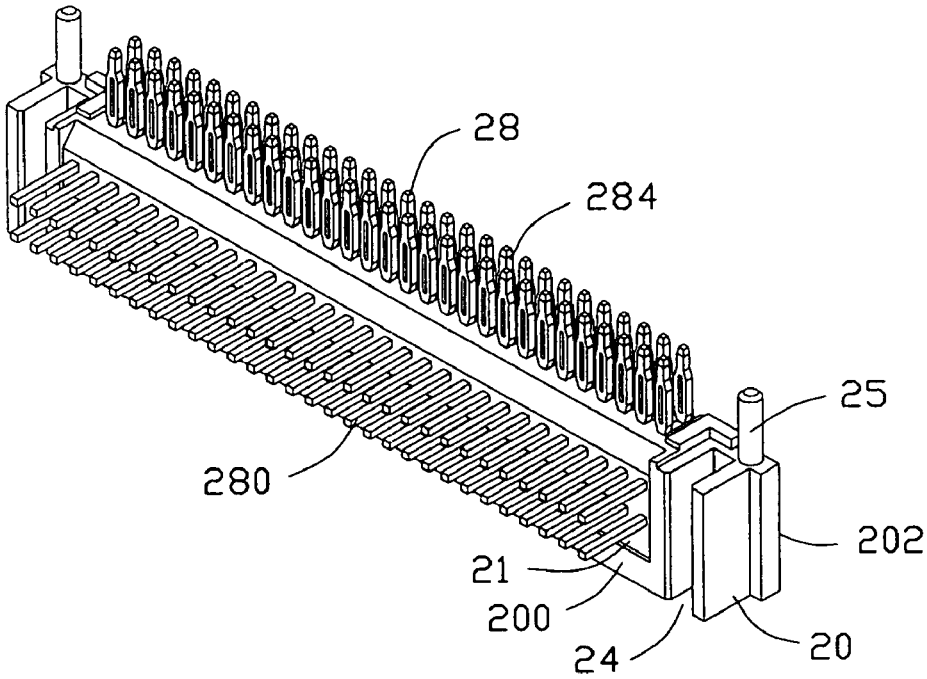
FIG. 8 is an assembled perspective view of the electrical connector shown in FIG. 7.

Referring to FIGS. 7 and 8, the electrical connector 2 comprises an insulating housing 20 and a plurality of terminals 28 retained in the insulating housing 20. The housing 20 is an elongated structure and has a front face 200, an opposite rear face 202 and a top face 203 connecting the front face 200 and the rear face 202. The housing 20 defines a depression 21 in the front face 200, a plurality of slits 22 in the top face 203 and the rear face 202, and a plurality of apertures 23 each communicating with the depression 21 and a corresponding slit 22. The housing 20 defines a pair of guiding channels 24 in the front face 200 and adjacent opposite longitudinal ends thereof for receiving the guiding posts 106 of the module cover 1. The insulating housing 20 is further formed with a pair of second polarizing posts 25 on the top face 203 adjacent the opposite longitudinal ends. The insulating housing 20 defines a pair of cutouts 26 (shown in FIG. 3) corresponding to the pair of snap protrusions 109 of the module cover 1.

Each terminal 28 includes an engaging portion 280 extending beyond the front face 200 of the housing 20 through a corresponding aperture 23, a right-angled intermediate portion 282 extending from the engaging portion 280 and received in a corresponding aperture 23 and a corresponding slit 22 for retaining the terminal 28 in the housing 20, and a press-fit tail 284 extending upwardly from the intermediate portion 282 beyond the top face 203 of the housing 20. The press-fit tail 284 is perpendicular to the engaging portion 280.

It is understood that the terminals 28 can also be insert molded with the insulating housing 20.

Referring to FIG. 3, the printed circuit board 3 defines a plurality of plated through holes 30 adjacent a front edge thereof, a first polarizing hole 32 (shown in FIG. 2) adjacent a rear edge thereof for receiving the first polarizing post 108 of the module cover 1, and a pair of second polarizing holes 34 adjacent the front edge for receiving the pair of second polarizing posts 25 of the electrical connector 2. The printed circuit board 3 has a pair of grounding pads 36 on a bottom face 300 thereof and adjacent the pair of second polarizing holes 34.

Referring to FIGS. 1–4 in conjunction with FIGS. 5–8, in assembly, the electrical connector 2 is placed into the receiving cavity 105 of the module cover 1 with the guiding posts 106 received in the guiding channels 24 to facilitate installation of the connector 2. The front face 200 of the housing 20 abuts against the inner face of the front wall 102. The engaging portions 280 of the terminals 28 extend into the mating space 110 of the mating portion 11 through the passageways 112 in the front wall 102 for engaging with a complementary device. The snap protrusions 109 on the bottom wall 101 snap into the cutouts 26 of the housing 20 for retaining the connector 2 in the receiving cavity 105 of the module cover 1.

After the connector 2 is installed in the receiving cavity 105 of the module cover 1, a potting compound 6 can be added to an interstitial space between the front wall 102 and the housing 20, i.e., the depression 21 of the housing 20 to achieve water sealing function for protecting the terminals 28. A pair of grounding members 5 (shown in FIG. 3), which is used for electrically contacting with the grounding pads 36 on the printed circuit board 3, is attached to the metal-coated inner face of the front wall 102 via PSA (Pressure Sensitive Adhesive) tape backing. The printed circuit board 3 is then assembled into the receiving cavity 105 of the module cover 1 with the bottom face 300 bearing against the supporting bumps 107. The first polarizing post 108 of the module cover 1 and the pair of second polarizing posts 25 of the housing 20 are respectively received in the first polarizing hole 32 and the pair of second polarizing holes 34 of the printed circuit board 3 for ensuring a correct engagement between the connector 2 and the printed circuit board 3. The press-fit tails 284 of the terminals 28 of the connector 2 are press-fitted into the plated through holes 30 of the printed circuit board 3 to establish an electrical connection therebetween. The grounding members 5 electrically connect the metal-coated inner face of the front wall 102 to the grounding pads 36 on the printed circuit board 3 to establish an EMI electrical connection between the module cover 1 and the printed circuit board 3.

In the preferred embodiment, the cover 4 is made from metal material and functions as a heat sink to cool controller chips (not shown) on the printed circuit board 3. Referring to FIGS. 1 and 2, after a wet sealant 7 is filled in the slot 124 of the flange 12 of the module cover 1, the heat sink 4 is assembled to the module cover 1 with peripheral edges received in the recess 122 of the flange 12. The heat sink 4 is held in place by the wet sealant 7 and is glued to the printed circuit board 3 to ensure a good contact and thermal performance therebetween. The transmission module assembly 100 is thus formed as shown in FIG. 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A module assembly comprising:

a module cover comprising a bottom wall, a front wall, a rear wall and two opposite side walls defining a receiving cavity therebetween and a mating portion extending forwardly from the front wall, the mating portion defining a mating space, the front wall defining a plurality of passageways communicating with the receiving cavity and the mating space;

an electrical connector received in the receiving cavity, the connector comprising an insulating housing and a plurality of terminals retained in the housing, each terminal including an engaging portion extending beyond a front face of the housing into the mating space through a corresponding passageway and a tail extending upwardly beyond a top face of the housing;

a printed circuit board received in the receiving cavity and electrically connecting with the terminals; and a cover member assembled to the module cover to cover the receiving cavity;

wherein the front face of the housing abuts against an inner face of the front wall, and the housing defines a depression in the front face, and wherein a potting compound is received in the depression for sealing the terminals.

2. The module assembly as claimed in claim 1, wherein the module cover is made from plastic material and is metalized on an inside area to provide EMI (Electro Magnetic Interference) shielding.

3. The module assembly as claimed in claim 2, further comprising a grounding member attached to a metalized inner face of the front wall, and wherein the cover member is made from metal material, the grounding member electrically connecting the metalized inner face of the front wall to a grounding pad on the printed circuit board.

4. The module assembly as claimed in claim 1, wherein the cover member is made from metal material and is glued to the printed circuit board.

5. The module assembly as claimed in claim 1, wherein the module cover is formed with a plurality of supporting bumps in the receiving cavity to support the printed circuit board.

6. The module assembly as claimed in claim 5, wherein one of the supporting bumps has a first polarizing post formed thereon, and the printed circuit board defines a first polarizing hole receiving the first polarizing post.

7. The module assembly as claimed in claim 6, wherein the housing of the connector is formed with a pair of second polarizing posts, and the printed circuit board defines a pair of second polarizing holes receiving the second polarizing posts.

8. The module assembly as claimed in claim 1, wherein the housing defines a cutout, and the bottom wall of the module cover is formed with a snap protrusion snapping into the cutout.

9. The module assembly as claimed in claim 1, wherein the module cover is formed with a pair of guiding posts on the inner face of the front wall, and the housing of the connector defines a pair of guiding channels receiving the guiding posts.

10. The module assembly as claimed in claim 1, wherein the module cover comprises a flange formed on individual tops of the front, the rear and the side walls, the flange defining four mounting holes at four corners thereof each for receiving a steel bushing.

11. The module assembly as claimed in claim 10, wherein the flange defines a recess in a top thereof around the receiving space, and the cover member has peripheral edges received in the recess.

12. The module assembly as claimed in claim 11, wherein the flange defines a slot recessed downwardly from the recess for accommodating a wet sealant.

13. A module assembly comprising:

a module cover comprising a bottom wall, a front wall, a rear wall and two opposite side walls defining a receiving cavity therebetween;

an electrical connector received in the receiving cavity and comprising an insulating housing and a plurality of terminals retained in the housing, each of said terminals including an engaging portion extending through the front wall and a tail perpendicular to the engaging portion;

a printed circuit board received in the receiving cavity and having a plurality of conductive pieces electrically and mechanically connected to the corresponding tails, respectively; and a cover member assembled to the module cover to cover the receiving cavity;

wherein a potting compound is positioned between the front wall of the cover and a front face of the housing, through which the engaging portion of the terminal extends.

14. The module assembly as claimed in claim 13, wherein the housing defines a depression in a front face thereof, a plurality of slits in a top and a rear faces thereof, and a plurality of apertures each communicating with the depression and a corresponding slit.

15. The module assembly as claimed in claim 14, wherein each terminal includes a right-angled intermediate portion received in a corresponding slit and aperture and connecting the engaging portion and the press-fit tail.

16. The module assembly as claimed in claim 13, wherein at least one snap protrusion is formed on said bottom wall to abut against a rear face of the housing for preventing backward movement of the connector relative to the cover in the receiving cavity.

* * * * *